US009823034B2

(12) United States Patent
Johnson et al.

(10) Patent No.: US 9,823,034 B2
(45) Date of Patent: Nov. 21, 2017

(54) SYSTEM AND METHOD FOR IMPROVING PERFORMANCE OF A WEAPON BARREL

(71) Applicant: Dreadnought Technologies, LLC, Crawfordsville, IN (US)

(72) Inventors: Christopher Johnson, Crawfordsville, IN (US); Jon Dantzig, Portland, OR (US); Robert Santini, West Lafayette, IN (US)

(73) Assignee: Dreadnought Technologies, LLC, Crawfordsville, IN (US)

( * ) Notice: Subject to any disclaimer, the term of this patent is extended or adjusted under 35 U.S.C. 154(b) by 0 days.

(21) Appl. No.: 15/246,338

(22) Filed: Aug. 24, 2016

(65) Prior Publication Data

US 2017/0115085 A1 Apr. 27, 2017

Related U.S. Application Data

(60) Provisional application No. 62/208,958, filed on Aug. 24, 2015.

(51) Int. Cl.
*F41A 21/36* (2006.01)

(52) U.S. Cl.
CPC ..... *F41A 21/36* (2013.01)

(58) Field of Classification Search
CPC ..... F41A 21/20; F41A 21/00; F41A 21/02; F41A 21/04
USPC ..... 89/14.3; 42/78, 76.01, 76.02
See application file for complete search history.

(56) References Cited

U.S. PATENT DOCUMENTS

| | | | | | |
|---|---|---|---|---|---|
| 2,302,699 | A * | 11/1942 | Klipsch | F41C 27/22 | 42/76.01 |
| 2,845,741 | A * | 8/1958 | Day | F41A 21/02 | 42/76.01 |
| 3,118,243 | A | 1/1964 | Manshel | | |
| 3,556,889 | A | 1/1971 | Grahn | | |
| 4,922,642 | A | 5/1990 | Ohlhauser | | |
| 5,778,590 | A | 7/1998 | Browning et al. | | |
| 5,794,374 | A | 8/1998 | Crandall | | |
| 5,798,473 | A | 8/1998 | Roblyer et al. | | |
| 6,497,065 | B1 | 12/2002 | Huston | | |
| 6,516,550 | B1 | 2/2003 | Schnyder et al. | | |
| 6,889,462 | B1 | 5/2005 | Carlson | | |
| 6,889,464 | B2 | 5/2005 | Degerness | | |
| 8,196,701 | B1 | 6/2012 | Oliver | | |
| 8,261,651 | B2 | 9/2012 | Casas Salva | | |
| 8,312,663 | B2 * | 11/2012 | Johnson | F41A 23/16 | 42/76.01 |
| 8,347,544 | B1 | 1/2013 | Swan | | |
| 8,595,971 | B2 * | 12/2013 | Johnson | F41A 13/12 | 42/76.01 |
| 2003/0093935 | A1 | 5/2003 | Huston | | |

(Continued)

*Primary Examiner* — Joshua E Freeman
(74) *Attorney, Agent, or Firm* — Ice Miller LLP

(57) ABSTRACT

A viscoelastic barrel dampener is provided including a shroud having an inner surface and an outer surface. A cavity is defined by the inner surface of the shroud. A barrel is positioned within the cavity. The barrel has an outer surface. A viscoelastic dampening material is disposed within the cavity and substantially fills a volume defined by the outer surface of the barrel and the inner surface of the shroud. At least one magnet is positioned on the outer surface of the shroud to apply a magnetic field to the viscoelastic dampening material.

24 Claims, 10 Drawing Sheets

(56) References Cited

U.S. PATENT DOCUMENTS

| | | | | |
|---|---|---|---|---|
| 2005/0034346 | A1* | 2/2005 | Smith | F41A 21/04 42/76.02 |
| 2006/0112818 | A1* | 6/2006 | Paul | F41A 25/22 89/14.3 |
| 2007/0062090 | A1 | 3/2007 | Brindle | |
| 2007/0256345 | A1 | 11/2007 | Hall et al. | |
| 2010/0132241 | A1* | 6/2010 | Mancini | F41A 21/02 42/76.02 |
| 2012/0227302 | A1* | 9/2012 | Fonte | F41A 21/02 42/78 |
| 2013/0247439 | A1* | 9/2013 | Johnson | F41A 13/12 42/97 |
| 2015/0252864 | A1* | 9/2015 | Hull | F16F 7/1011 188/267 |
| 2015/0267981 | A1* | 9/2015 | Faughn | F41A 9/62 42/1.02 |
| 2016/0320156 | A1* | 11/2016 | Curliss | F41A 21/02 |

* cited by examiner

SYSTEM AND METHOD FOR IMPROVING PERFORMANCE OF A WEAPON BARREL

CROSS-REFERENCE TO RELATED APPLICATIONS

The present application is a non-provisional patent application of, and claims priority to, U.S. Patent Application Ser. No. 62/208,958, filed Aug. 24, 2015, and title "SYSTEM AND METHOD FOR IMPROVING PERFORMANCE OF A WEAPON BARREL," the text and drawings of which are herein incorporated by reference.

BACKGROUND

Sniper rifles and other high-accuracy guns and artillery are designed to repeatedly deliver a projectile accurately and precisely. However, variations and other effects within the barrel, including perturbations caused by acoustic disturbances produced by the act of firing, can cause substantial changes to the trajectory or flight path of a projectile, thereby causing a decrease in accuracy. Currently, methods for reducing such perturbations typically relate to devices operable to mechanically stabilize a muzzle at the point where the bullet exits the barrel, such as those discussed in U.S. Pat. No. 5,794,374, or the use of movable counterweights such as those marketed under the mark Limbsaver®. Other methods for reducing such perturbations include U.S. Pat. Nos. 5,798,473 and 6,889,462, which utilize a spring system for tensioning a barrel until its "sweet spot" is found to reduce variability in the accuracy of a weapon barrel. Additionally, many of the aforementioned methods exhibit dramatic degradations in performance as the temperature of the weapon barrel increases or with a change in ammunition.

It would be appreciated in the art to supply a system and method for reducing the variability induced in a barrel through a range of acoustic disturbances and temperatures without the need to iteratively tension and/or counterbalance then field test each spring loading configuration or counterweight position for each individual barrel and ammunition type. The elimination of movable components that might loosen or break also would be appreciated in the art. Therefore, there is a need for a system and method of improving the performance of a weapon barrel that overcomes the limitations of the prior art without adding substantial weight to the weapon, especially in military systems where any weight penalty is of critical importance.

BRIEF SUMMARY

In one aspect, a viscoelastic barrel dampener is provided including a shroud having an inner surface and an outer surface. A cavity is defined by the inner surface of the shroud. A barrel is positioned within the cavity. The barrel has an outer surface. A viscoelastic dampening material is disposed within the cavity and substantially fills a volume defined by the outer surface of the barrel and the inner surface of the shroud. At least one magnet is positioned on the outer surface of the shroud to apply a magnetic field to the viscoelastic dampening material.

In one aspect, the magnetic field is at least one of static or dynamic nature.

In one aspect, the viscoelastic dampening material is Ferro-magnetic.

In one aspect, the viscoelastic dampening material includes at least one of iron, nickel, or cobalt particles in a polymer matrix.

In one aspect, the viscoelastic dampening material includes at least one of iron, nickel, or cobalt particles in a high viscosity lubricant matrix.

In one aspect, the at least one magnet is at least one of permanent or electrically developed.

In one aspect, the shroud is a non-cylindrical shroud.

In one aspect, the non-cylindrical shroud has at least one of a square cross-sectional area, a pentagonal cross-sectional area, a hexagonal cross-sectional area, an octagonal cross-sectional area, a triangular cross-sectional area.

In one aspect, the non-cylindrical shroud has a polygonal cross-sectional area.

In one aspect, at least one rib extends from the inner surface of the shroud to the outer surface of the barrel.

In one aspect, the at least one rib extends radially inward from the inner surface of the shroud to the outer surface of the barrel.

In one aspect, the viscoelastic dampening material is disposed adjacent the at least one rib.

In one aspect, a method of manufacturing a viscoelastic barrel dampener is provided. The method includes positioning a barrel within a cavity defined by an inner surface of a shroud. The barrel has an outer surface. A viscoelastic dampening material is disposed within the cavity and substantially filling a volume defined by the outer surface of the barrel and the inner surface of the shroud. At least one magnet is positioned on the outer surface of the shroud to apply a magnetic field to the viscoelastic dampening material.

In one aspect, the applied magnetic field is at least one of a static or a dynamic magnetic field.

In one aspect, disposing a viscoelastic dampening material includes disposing a Ferro-magnetic viscoelastic dampening material.

In one aspect, disposing a viscoelastic dampening material includes disposing a viscoelastic dampening material having at least one of iron, nickel, or cobalt particles in a polymer matrix.

In one aspect, disposing a viscoelastic dampening material includes disposing a viscoelastic dampening material having at least one of iron, nickel, or cobalt particles in a high viscosity lubricant matrix.

In one aspect, positioning at least one magnet includes positioning at least one of a permanent or electrically developed magnet.

In one aspect, positioning a barrel includes positioning the barrel in a non-cylindrical shroud.

In one aspect, positioning a barrel includes positioning the barrel in a non-cylindrical shroud that has at least one of a square cross-sectional area, a pentagonal cross-sectional area, a hexagonal cross-sectional area, an octagonal cross-sectional area, a triangular cross-sectional area.

In one aspect, positioning a barrel includes positioning the barrel in a non-cylindrical shroud that has a polygonal cross-sectional area.

In one aspect, at least one rib is extended from the inner surface of the shroud to the outer surface of the barrel.

In one aspect, the at least one rib is extended radially inward from the inner surface of the shroud to the outer surface of the barrel.

In one aspect, the viscoelastic dampening material is disposed adjacent the at least one rib.

BRIEF DESCRIPTION OF THE DRAWINGS

The above mentioned embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION

Figure 1:
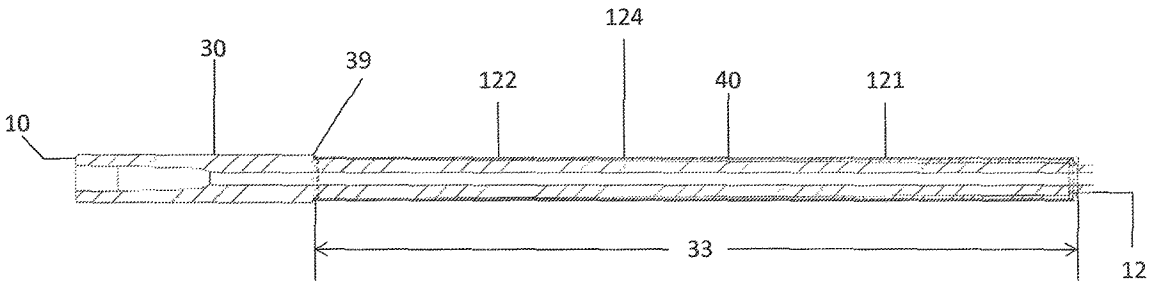
FIG. 1 is a cross-sectional side view of a non-circular barrel shroud in accordance with an embodiment.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended. The disclosure of the present application includes systems and methods for improving the performance of a weapon barrel included in a weapon assembly by creating a high-loss, acoustic waveguide, which attenuates and absorbs acoustic vibrational energy over a range of frequencies produced in the barrel by the combustion of propellant when firing the weapon, thereby improving performance and accuracy.

The present disclosure describes various embodiments of barrel shrouds that may be used with any weapon, including, but not limited to, the weapons described in U.S. Pat. No. 8,312,663 filed Mar. 18, 2010 and titled "SYSTEM AND METHOD FOR IMPROVING PERFORMANCE OF A WEAPON BARREL" and U.S. Pat. No. 8,595,971 filed Nov. 2, 2012 and titled "SYSTEM AND METHOD FOR IMPROVING PERFORMANCE OF A WEAPON BARREL," which are both incorporated herein in their entirety.

Figure 2:
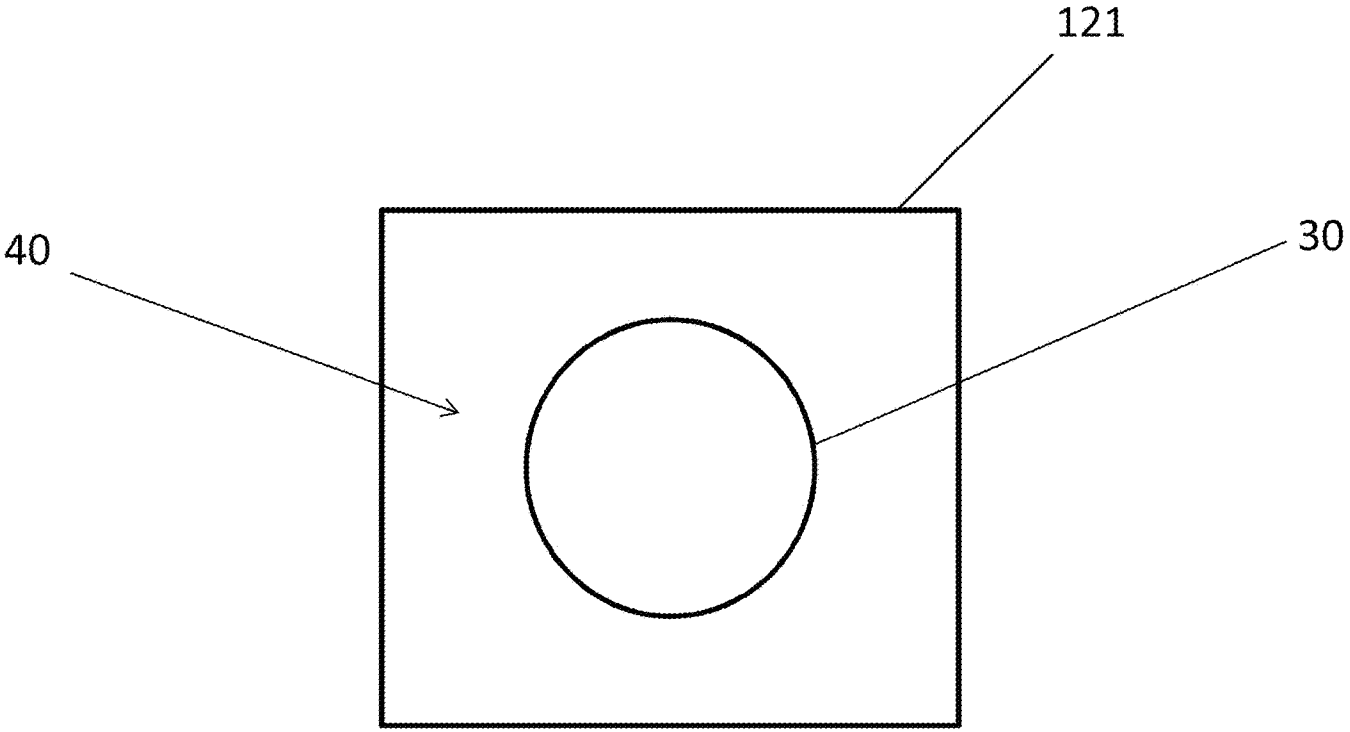
FIG. 2 is a cross-sectional view of a barrel and non-cylindrical barrel shroud in accordance with an embodiment.
Figure 3:
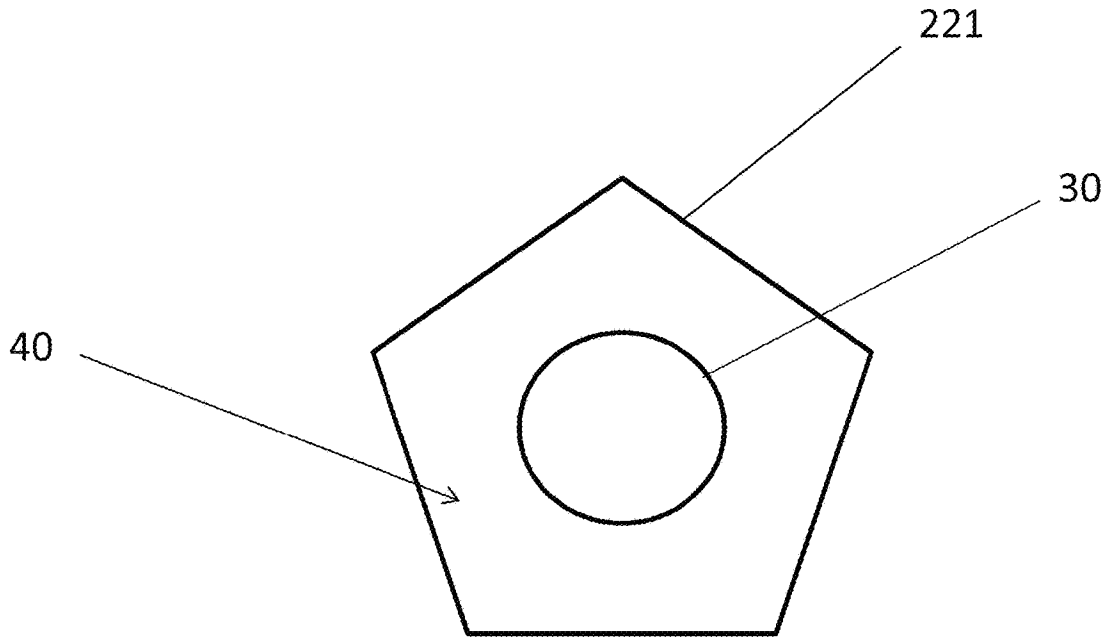
FIG. 3 is a cross-sectional view of a barrel and non-cylindrical barrel shroud in accordance with an embodiment.
Figure 4:
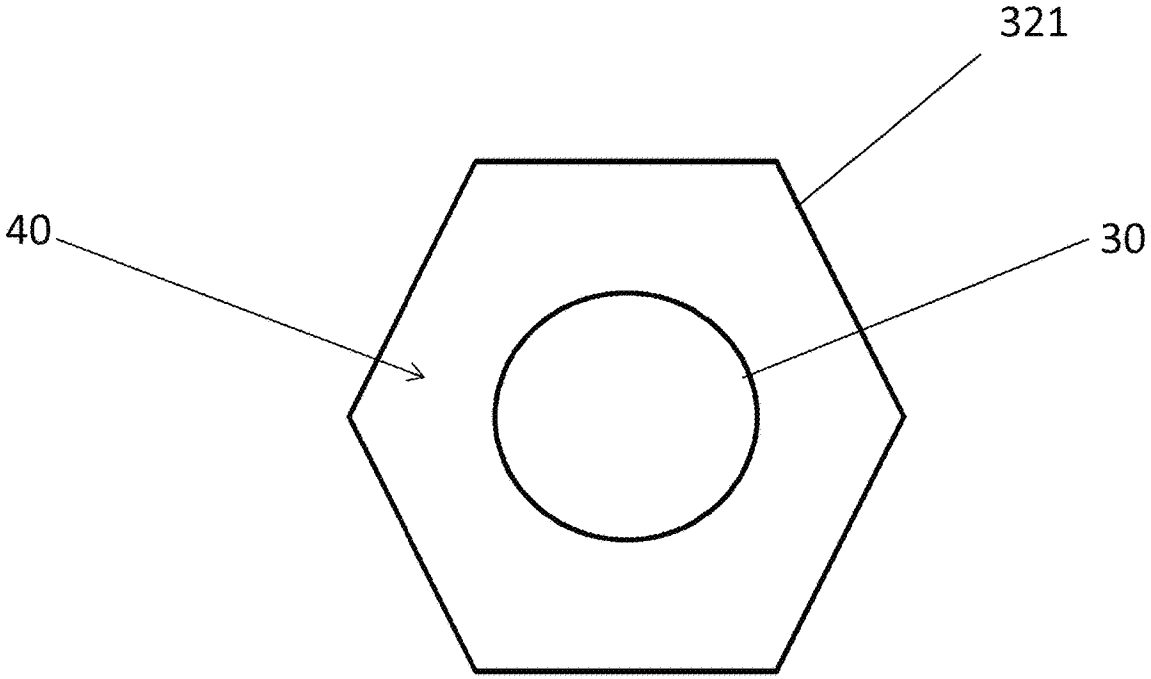
FIG. 4 is a cross-sectional view of a barrel and non-cylindrical barrel shroud in accordance with an embodiment.
Figure 5:
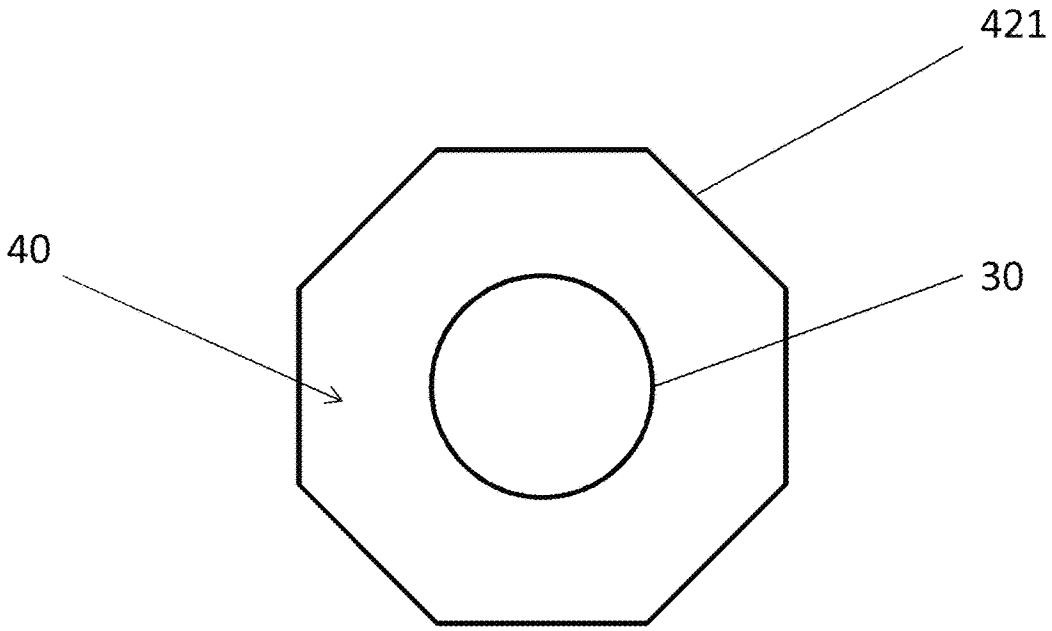
FIG. 5 is a cross-sectional view of a barrel and non-cylindrical barrel shroud in accordance with an embodiment.
Figure 6:
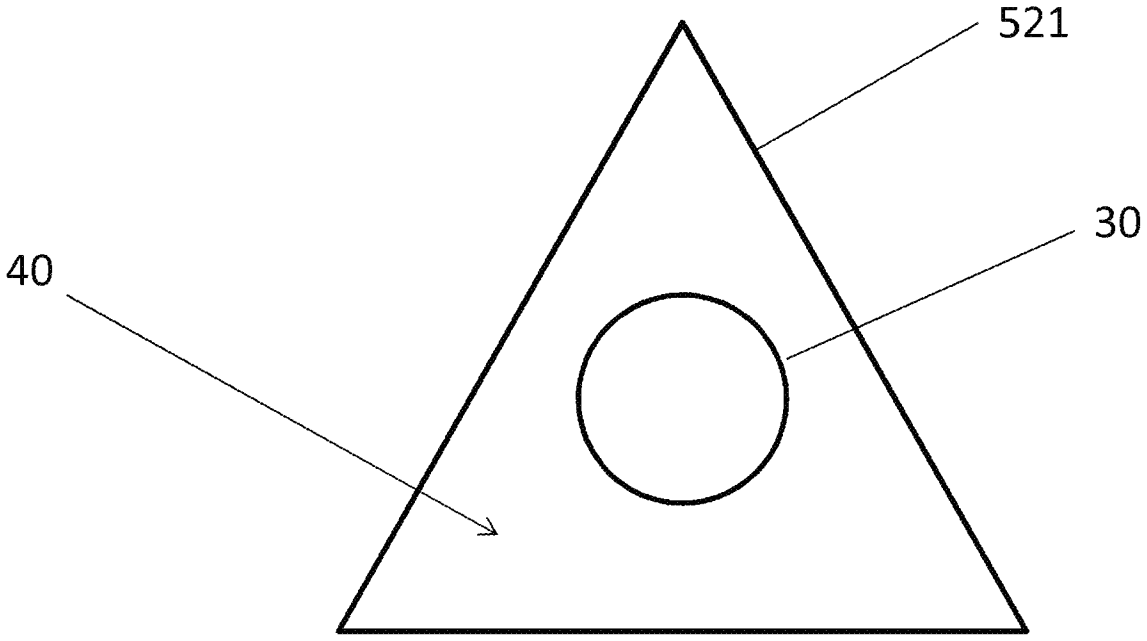
FIG. 6 is a cross-sectional view of a barrel and non-cylindrical barrel shroud in accordance with an embodiment.

FIGS. 1 and 2 illustrate a barrel shroud 121 that may include a substantially non-cylindrical portion having an outer surface 122 and an interior cavity 124 defined within the outer surface 122. For example, the barrel shroud 121 may have a polygonal cross-sectional area. In one embodiment, the polygon may have n sides of any practical number. The barrel shroud 121 may be formed with an interior cavity 124 large enough to encase a barrel 30 along the contoured length 33 from or near the action end 10 to or near a muzzle end 12. In at least one embodiment, the barrel shroud 121 may seat against the shoulder 39 toward an action end 10 of the barrel 30. The barrel shroud 121 may be formed of a metal (e.g., titanium), alloy, polymer, composite, fiberglass, carbon fiber, or other suitable material. The choice of material for the barrel shroud 121 may be a factor in reducing the weight of a weapon assembly incorporating a viscoelastic barrel dampener material 40. Another factor affecting the shroud material would be how it is affected by magnetic fields. In the embodiment shown in FIG. 2, the barrel shroud 121 has a squared cross-sectional area. Alternatively, a barrel shroud 221 may have a pentagonal cross-sectional area, as illustrated in FIG. 3. In one embodiment, a barrel shroud 321 may have a hexagonal cross-sectional area, as illustrated in FIG. 4. Optionally, a barrel shroud 421 may have an octagonal cross-sectional area, as illustrated in FIG. 5. In one embodiment, a barrel shroud 521 may have a triangular cross-sectional area, as illustrated in FIG. 6. Additionally it should be noted as a non-limiting example these cross sections do not necessarily continue the entire length of the shroud. In fact, multiple different cross sections could be employed for convenience or need depending on specific applications.

Figure 7:
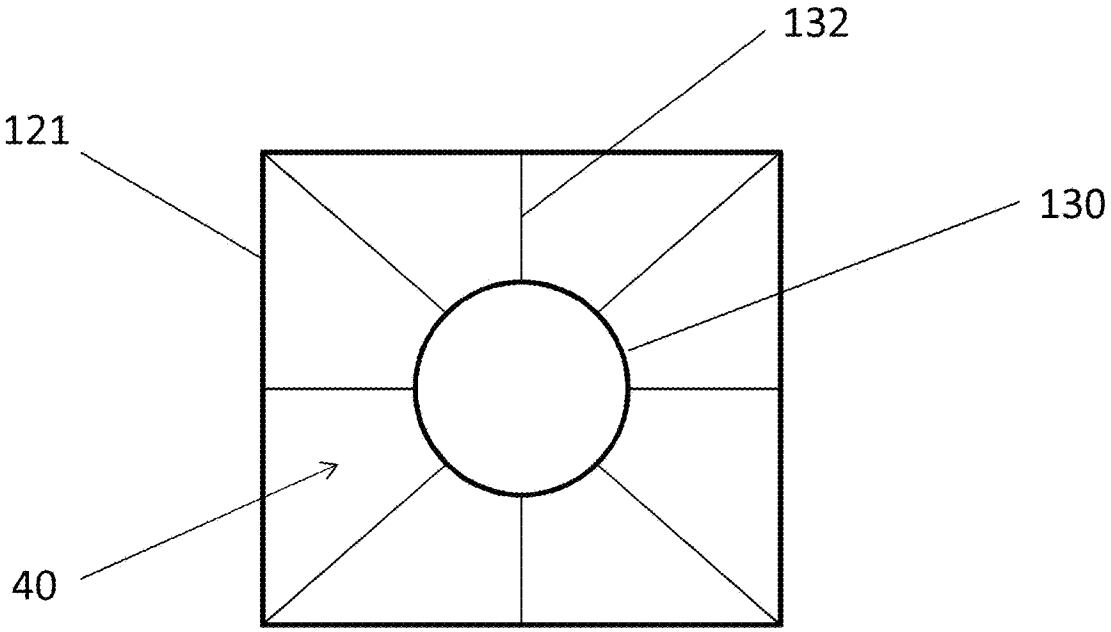
FIG. 7 is a cross-sectional view of a barrel and non-cylindrical barrel shroud in accordance with an embodiment.

FIG. 7 illustrates an embodiment of a barrel 130 that may be utilized with any of the barrel shrouds 121, 221, 321, 421, and 521 shown in FIGS. 1-6. In FIG. 7, the barrel 130 is illustrated with the shroud 121. The barrel 130 includes at least one rib 132 that extends a length of the barrel 132. The at least one rib 132 may extend radially outward from the barrel 130. In one embodiment, the at least one rib 132 extends from the barrel 130 to the shroud 121. The illustrated embodiment includes a plurality of ribs 132. The ribs 132 extend from the barrel 130 through the interior cavity 124 and connect to the barrel shroud 121. The method of connecting the at least one rib to the shroud includes welding, bolting, soldering, riveting, screwing, the use of adhesives or simple contact/pressure joints. In one embodiment, the viscoelastic dampener material 40 may be positioned between each of the ribs 132. In one embodiment, the main mode of vibration is the fundamental for a cantilever beam. The ribs 132 provide stiffness to minimize movement in that mode and prevent deflection by stiffening.

In one embodiment, the rib 132 may be touching the shroud 121. In one embodiment, the rib 132 does not touch the shroud 121. In one embodiment, the rib 132 may be implemented as a number of favorable side sections, for example a rectangular cross-section profile with the major axis oriented on a bore axis of the barrel. Other side sections could be shaped to conform to standing waves on the barrel such that their maximum area is concentrated at points of maximum transient displacement of the barrel during firing. In one embodiment, the damping material may be tailored to partially fill or fully fill the volume between adjacent ribs 132 to achieve maximum barrel damping.

In one embodiment, the ribs 132 extend from the barrel to the shroud 121 with a clearance between the ribs 132 and the shroud 121 such that transverse viscous flow occurs around an edge of the rib 132. In one embodiment, the ribs 132 are fixed to the shroud 121 and the clearance occurs at the barrel outer surface. In one embodiment, the clearance alternates between the shroud 121 and the barrel.

In one embodiment, the ribs 132 are a diamagnetic material such as mild copper alloy. If a barrel is built with such ribs 132 in place that do not touch the shroud 121, the ribs 132 alone will provide more braking effect than the polymer plus magnetic or diamagnetic filler. A set of curved permanent magnets oriented to produce a N/S/N/S/N/S/N/S arrangement around a 4 section round shroud will induce eddy currents on the ribs 132 and be a self-shielding assembly with no external fields.

The polygon shape modifies the cantilevered beams response to vibration, facilitating improving long term response of the system. In one embodiment, applications might be machine guns and high rep rate anti-armor guns that try to shoot approximately two or three times before the gun moves out of battery. Other applications may include systems that are subject to large amounts of external vibration. Such systems may include tank cannon employed on moving vehicles; naval cannon on moving ships; and rail guns which are subject to extreme vibration during their electrical discharge phase. In one embodiment, the non-circular cross-sectional area of the shroud increases the moment of inertia of the shroud such that the fundamental frequency is higher. For example, an area moment of inertia can be expressed as:

$$I_x=\int y^2 dA,$$

where $I_x$=area moment of inertia ($m^4$, $mm^4$, $inches^4$); y=the perpendicular distance from axis x to the element dA (m, mm, inches); and dA=an elemental area ($m^2$, $mm^2$, $inches^2$). Accordingly, the moment of inertia of a beam having a square cross-section may be expressed as:

$$I_x=b^4/12$$

$$I_y=b^4/12,$$

where b=side.

The moment of inertia of a circle may be expressed as:

$$I_x=\pi r^4/4=\pi d^4/64$$

$$I_y=\pi r^4/4=\pi d^4/64,$$

where $r$=radius and $d$=diameter

As such, a circular cross section (1.125 round bar) has 1/27th the moment of inertia of a square cross-section (1.125 square bar). Alternatively, a square beam has a moment of inertia of 1.7 times that of a tube of the same overall dimension.

Within the shroud and surrounding the barrel, the barrel is emplaced via casting, curing, injecting or applying a viscoelastic barrel dampener. This dampener can be composed of a non-limiting polymer which exhibits large storage capacity of vibration energies in a broad range of frequencies associated with the firing of a weapon. It should be understood that other visco elastic dampeners are also possible. An additional non-limiting aspect would include a viscoelastic barrel dampener composed of a Ferro-magnetic material and an external magnetic field. This results from a combination of Ferro-magnetic particles like elemental iron, nickel, cobalt or suitable compounds of these elements within a non-crystalline matrix of high viscosity lubricant or any number of flexible polymers or other non-crystalline substances. Under a magnetic field these particles within the matrix interact with the external magnetic field and transfer energy to the matrix, which functions as a viscous dampener. The Ferro-magnetic fluid's operational damping characteristics are a function of the particle concentration, unassisted matrix damping and the magnetic field strength. In one embodiment, the magnetic field is with reference to the field between the inner surface of the shroud and the outer surface of the barrel. It should be appreciated that the external magnetic field strength will both adjust and modify the viscosity of the dampener. This can accommodate systems which might wish to have a variable dispersion such as shotguns. Additionally, as the magnetic field can be customized, it should also be understood that dispersions can be adjusted horizontally and vertically independent of each other, there-by allowing for a machine gun dispersion to be primarily horizontal instead of circular.

Figure 8:
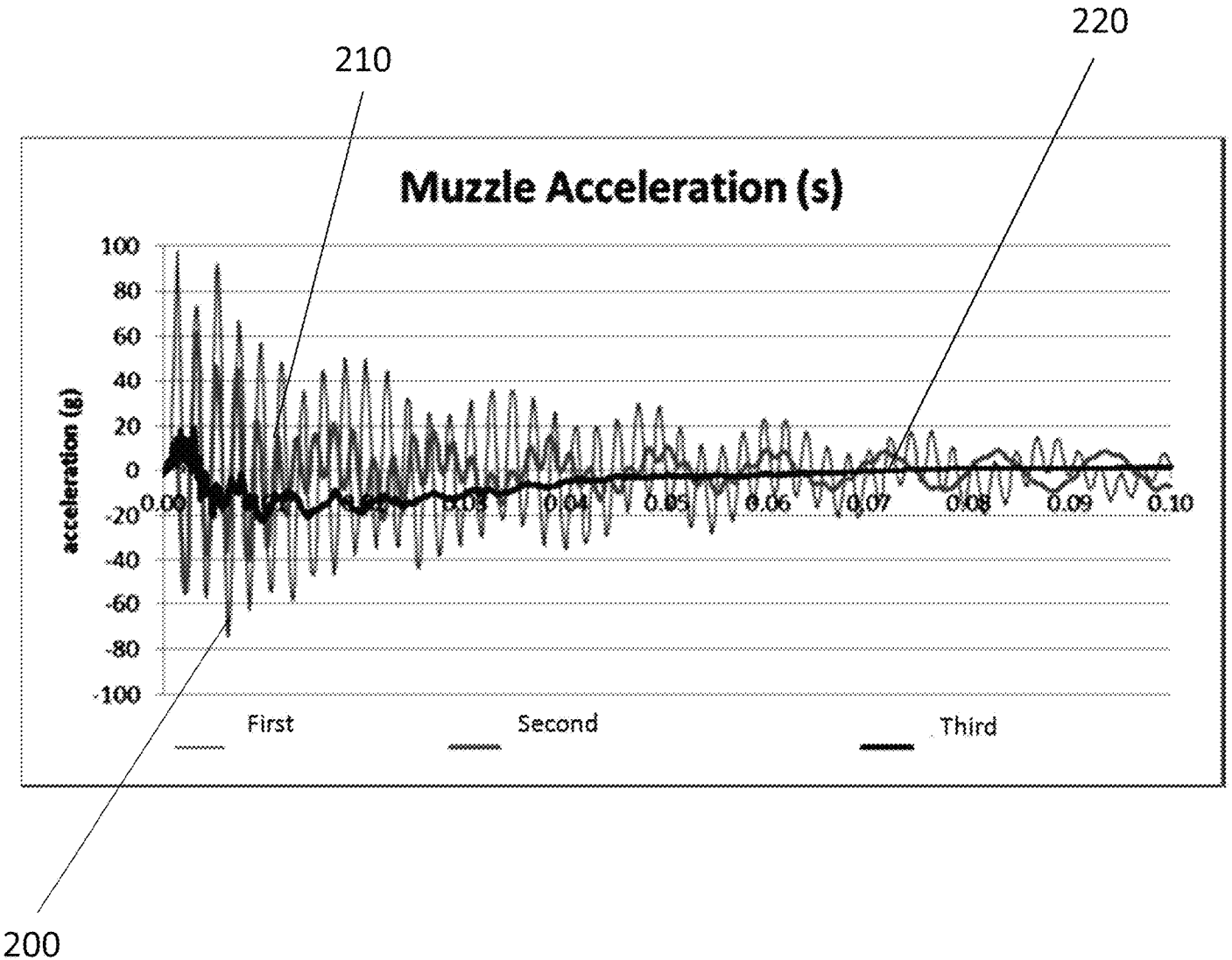
FIG. 8 is a graph illustrating the acceleration of a barrel for the first 100 milliseconds after a round is initiated in accordance with an embodiment.

FIG. 8 is a graph illustrating the acceleration of a barrel for the first 100 milliseconds after a round is initiated. As illustrated by the first line 200 (with the smallest width), a conventional barrel that has not been coated with the viscoelastic dampening material and does not have a shroud or viscoelastic dampening has a muzzle acceleration as shown for the first 100 milliseconds. As illustrated by the second line 210 (with the medium width), a barrel coated with the viscoelastic dampening material and having a cylindrical shroud has a muzzle acceleration substantially improved over the same 100 milliseconds. As illustrated by the third line 220 (with the largest width), a barrel coated with the viscoelastic dampening material and having a square shroud has a muzzle acceleration substantially reduced from that of either the unmodified barrel or the barrel with only a round shroud and viscoelastic dampener. Additionally, the data illustrate that the square shroud also considerably decreases the amount of acceleration throughout the entire firing process. It should be appreciated that these acceleration data have been collected from actual barrels firing conventional bullets under real world conditions. The conventional barrel and cylindrical shroud data were collected with the participation of the United States Army Picatinny Arsenal. As such, the data demonstrates that the addition of a non-cylindrical barrel shroud reduces the amount of vibration in the barrel in comparison to a cylindrical barrel shroud. While an individual bullet will leave the barrel in under 2 milliseconds, it should be appreciated that automatic weapons, also called machine guns, will initiate subsequent rounds within 50 to 100 milliseconds. Thus the application of the square shroud and viscoelastic dampener has the potential to drastically reduce the accelerations experienced by the muzzle of a machine gun while firing multiple rounds. Additionally, there are or could be cannon designed to fire multiple rounds in a short time frame, i.e., 2 or 3 rounds fired before the weapon recoils out of battery, the intent being to hit a target with multiple rounds in nearly the same place on the armor to ensure a defeat of its armor. Thus for these high cyclic rate weapons such as auto cannons the dampening could provide great improvements in accuracy.

Figure 9:
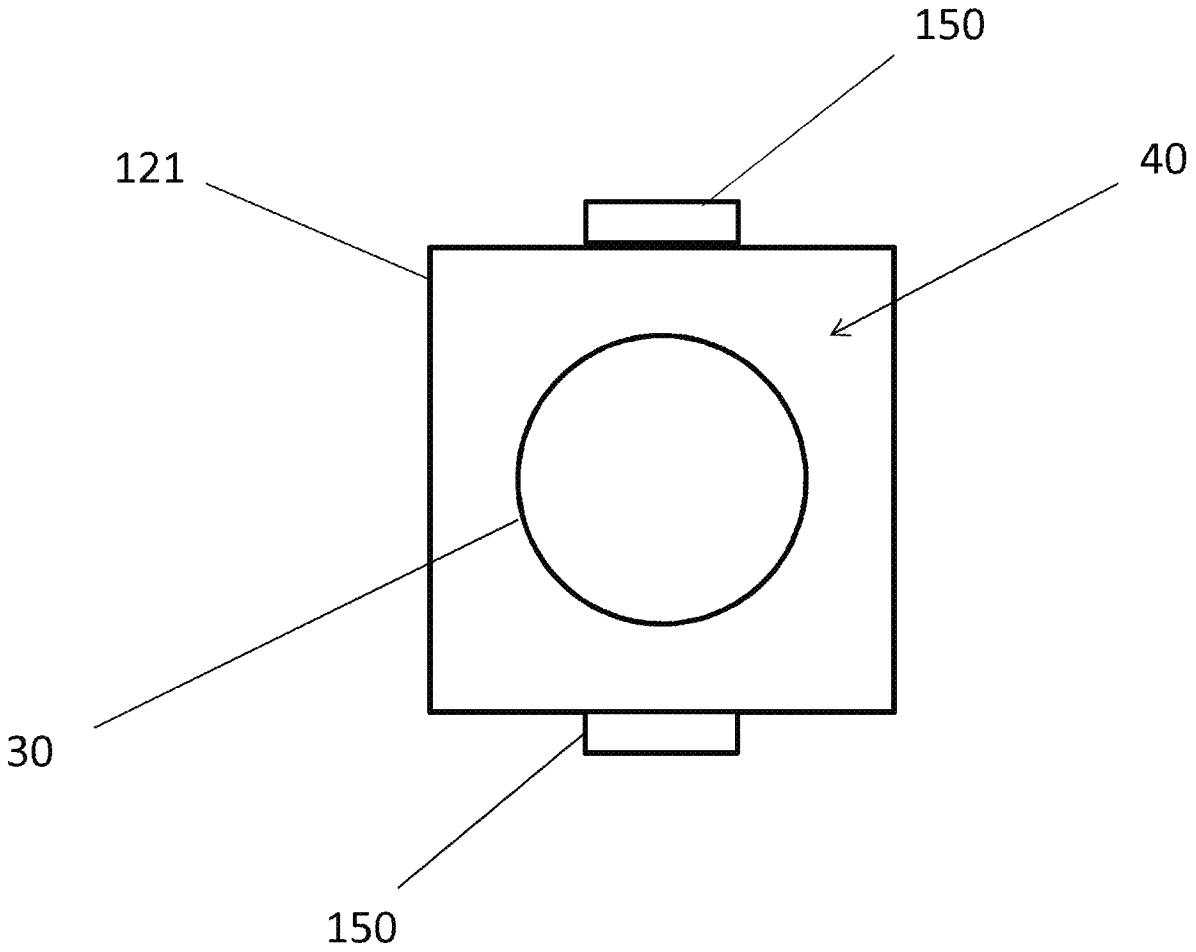
FIG. 9 is a cross-sectional view of a barrel and non-cylindrical barrel shroud having a magnet thereon in accordance with an embodiment.
Figure 10:
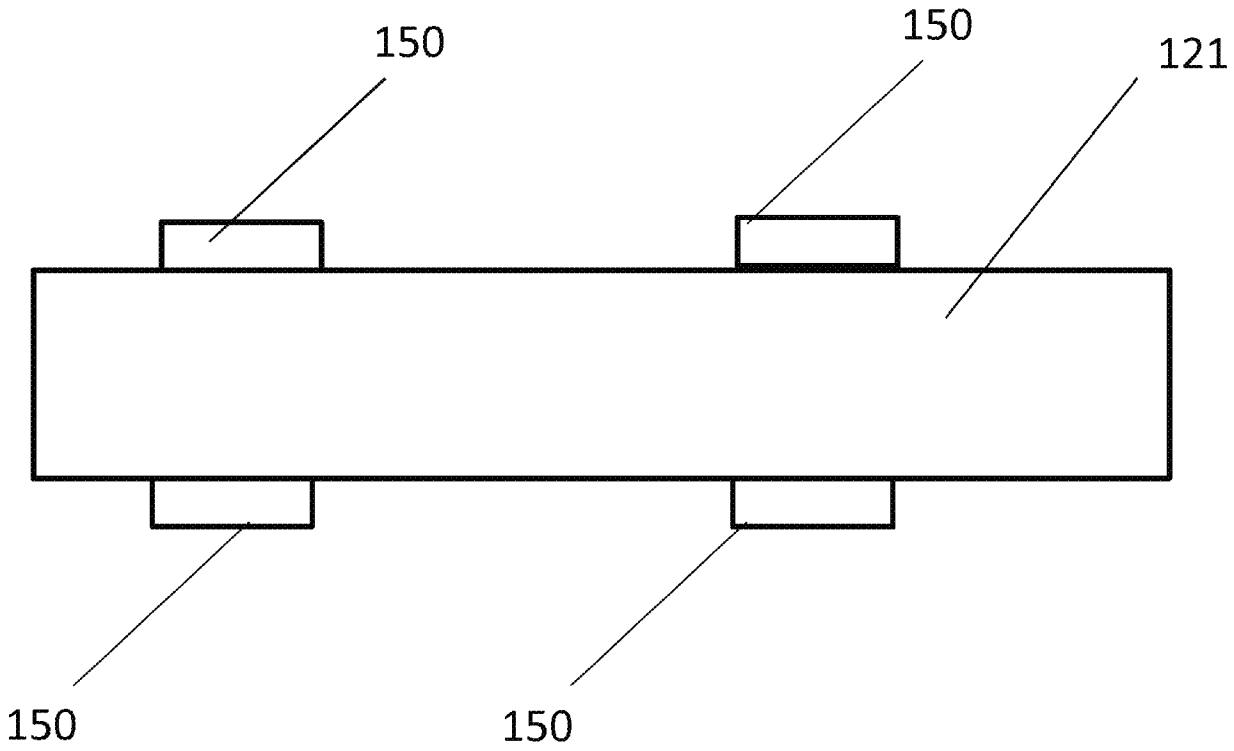
FIG. 10 is a side view of a non-cylindrical barrel shroud having a magnet thereon in accordance with an embodiment.

FIGS. 9 and 10 illustrate the shroud 121 having at least one magnet 150 positioned on an outer surface thereof. In such an embodiment, the viscoelastic dampener material 40 may be composed of Ferro-magnetic material, thereby making the viscoelastic dampener material Ferro-magnetic. In one embodiment, the viscoelastic dampener material 40 includes Ferro-magnetic particles having at least one of iron, nickel, or cobalt particles, or a combination thereof, in a polymer matrix. In one embodiment, the viscoelastic dampener material 40 includes Ferro-magnetic particles having at least one of iron, nickel, or cobalt particles, or a combination thereof, in a high viscosity lubricant matrix. In one embodiment, the magnet is at least one of permanent or electrically developed. The magnet 150 is constructed and arranged to apply a magnetic field on the viscoelastic dampener material. In one embodiment, the magnetic field is at least one of static or dynamic. Under the magnetic field generated by the magnet 150, functioning as part of the shroud, the Ferro-magnetic particles within the matrix align with an external magnetic field and function as a viscous dampener. The Ferro-magnetic material's viscosity is a function of the particles, matrix and the external magnetic field.

While various embodiments of viscoelastic barrel dampener and methods for using the same have been described in considerable detail herein, the embodiments are merely offered by way of non-limiting examples of the disclosure described herein. It will therefore be understood that various changes and modifications may be made, and equivalents may be substituted for elements thereof, without departing from the scope of the disclosure. Indeed, this disclosure is not intended to be exhaustive or to limit the scope of the disclosure. For instance, it is anticipated that a viscoelastic barrel dampener as disclosed herein will produce similar results on other barrels beyond conventional small firearms. For example, tank cannon, artillery barrels, and potentially electromagnetic rail gun applications are anticipated to behave similarly, and the viscoelastic barrel dampener 20 is intended to encompass applications thereon.

Further, in describing representative embodiments, the disclosure may have presented a method and/or process as a particular sequence of steps. However, to the extent that the method or process does not rely on the particular order of steps set forth herein, the method or process should not be limited to the particular sequence of steps described. Other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

The invention claimed is:

1. A viscoelastic barrel dampener, the viscoelastic barrel dampener comprising:

a shroud having an inner surface and an outer surface;

a cavity defined by the inner surface of the shroud, wherein a barrel is positioned within the cavity, the barrel having an outer surface;

a viscoelastic dampening material disposed within the cavity and substantially filling a volume defined by the outer surface of the barrel and the inner surface of the shroud; and at least one magnet positioned on the outer surface of the shroud to apply a magnetic field to the viscoelastic dampening material.

2. The viscoelastic barrel dampener of claim 1, wherein the magnetic field is at least one of static or dynamic nature.

3. The viscoelastic barrel dampener of claim 1, wherein the viscoelastic dampening material is Ferro-magnetic.

4. The viscoelastic barrel dampener of claim 1, wherein the viscoelastic dampening material further comprises at least one of iron, nickel, or cobalt particles in a polymer matrix.

5. The viscoelastic barrel dampener of claim 1, wherein the viscoelastic dampening material further comprises at least one of iron, nickel, or cobalt particles in a high viscosity lubricant matrix.

6. The viscoelastic barrel dampener of claim 1, wherein the at least one magnet is at least one of permanent or electrically developed.

7. The viscoelastic barrel dampener of claim 1, wherein the shroud is a non-cylindrical shroud.

8. The viscoelastic barrel dampener of claim 7, wherein the non-cylindrical shroud has at least one of a square cross-sectional area, a pentagonal cross-sectional area, a hexagonal cross-sectional area, an octagonal cross-sectional area, a triangular cross-sectional area.

9. The viscoelastic barrel dampener of claim 7, wherein the non-cylindrical shroud has a polygonal cross-sectional area.

10. The viscoelastic barrel dampener of claim 1 further comprising at least one rib extending from the inner surface of the shroud to the outer surface of the barrel.

11. The viscoelastic barrel dampener of claim 10, wherein the at least one rib extends radially inward from the inner surface of the shroud to the outer surface of the barrel.

12. The viscoelastic barrel dampener of claim 10, wherein the viscoelastic dampening material is disposed adjacent the at least one rib.

13. A method of manufacturing a viscoelastic barrel dampener, the method comprising:

positioning a barrel within a cavity defined by an inner surface of a shroud, the barrel having an outer surface;

disposing a viscoelastic dampening material within the cavity and substantially filling a volume defined by the outer surface of the barrel and the inner surface of the shroud;

positioning at least one magnet on the outer surface of the shroud to apply a magnetic field to the viscoelastic dampening material.

14. The method of claim 13, wherein the applied magnetic field is at least one of a static or a dynamic magnetic field.

15. The method of claim 13, wherein disposing a viscoelastic dampening material further comprises disposing a Ferro-magnetic viscoelastic dampening material.

16. The method of claim 13, wherein disposing a viscoelastic dampening material further comprises disposing a viscoelastic dampening material having at least one of iron, nickel, or cobalt particles in a polymer matrix.

17. The method of claim 13, wherein disposing a viscoelastic dampening material further comprises disposing a viscoelastic dampening material having at least one of iron, nickel, or cobalt particles in a high viscosity lubricant matrix.

18. The method of claim 13, wherein positioning at least one magnet further comprises positioning at least one of a permanent or electrically developed magnet.

19. The method of claim 13, wherein positioning a barrel further comprises positioning the barrel in a non-cylindrical shroud.

20. The method of claim 19, wherein positioning a barrel in a non-cylindrical shroud further comprises positioning the barrel in a non-cylindrical shroud that has at least one of a square cross-sectional area, a pentagonal cross-sectional area, a hexagonal cross-sectional area, an octagonal cross-sectional area, a triangular cross-sectional area.

21. The method of claim 19, wherein positioning a barrel in a non-cylindrical shroud further comprises positioning the barrel in a non-cylindrical shroud that has a polygonal cross-sectional area.

22. The method of claim 13 further comprising extending at least one rib from the inner surface of the shroud to the outer surface of the barrel.

23. The method of claim 22 further comprising extending the at least one rib radially inward from the inner surface of the shroud to the outer surface of the barrel.

24. The method of claim 22 further comprising disposing the viscoelastic dampening material adjacent the at least one rib.

* * * * *